US006497215B1

(12) United States Patent
Gaessler et al.

(10) Patent No.: US 6,497,215 B1
(45) Date of Patent: Dec. 24, 2002

(54) DEVICE FOR RAPIDLY BUILDING-UP PRESSURE IN A DEVICE OF A MOTOR VEHICLE, SAID DEVICE BEING SUPPLIED WITH A PRESSURE MEDIUM BY MEANS OF A FEED PUMP

(75) Inventors: Hermann Gaessler, Vaihingen (DE); Udo Diehl, Stuttgart (DE); Karsten Mischker, Leonberg (DE); Rainer Walter, Pleidelsheim (DE); Bernd Rosenau, Tamm (DE); Juergen Schiemann, Markgroeningen (DE); Christian Grosse, Kornwestheim (DE); Georg Mallebrein, Korntal-Muenching (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,047

(22) PCT Filed: May 27, 2000

(86) PCT No.: PCT/DE00/01726

§ 371 (c)(1),
(2), (4) Date: Oct. 24, 2001

(87) PCT Pub. No.: WO01/27467

PCT Pub. Date: Apr. 19, 2001

(30) Foreign Application Priority Data

Oct. 14, 1999 (DE) ..... 199 49 514

(51) Int. Cl.[7] ..... F02M 37/04

(52) U.S. Cl. ..... 123/447; 123/511; 123/179.16; 123/179.17

(58) Field of Search ..... 123/456, 510, 123/511, 447, 179.16, 179.17

(56) References Cited

U.S. PATENT DOCUMENTS

| | | | | | |
|---|---|---|---|---|---|
| 4,627,403 | A | * | 12/1986 | Matsumura | 123/447 |
| 5,152,271 | A | * | 10/1992 | Matsumura | 123/447 |
| 5,456,233 | A | * | 10/1995 | Felhofer | 123/456 |
| 5,546,912 | A | * | 8/1996 | Yamada et al. | 123/511 |
| 5,701,869 | A | * | 12/1997 | Richardson et al. | 123/497 |
| 5,711,263 | A | * | 1/1998 | Brown | 123/179.9 |
| 5,809,771 | A | * | 9/1998 | Wernberg | 123/447 |
| 6,092,500 | A | * | 7/2000 | Frank et al. | 123/198 D |
| 6,234,128 | B1 | * | 5/2001 | Reuss | 123/179.17 |
| 6,279,544 | B2 | * | 8/2001 | Rumpf | 123/511 |

FOREIGN PATENT DOCUMENTS

| | | | | |
|---|---|---|---|---|
| DE | 42 15 721 | * | 11/1993 | F02M/59/42 |

* cited by examiner

*Primary Examiner*—Thomas N. Moulis
(74) *Attorney, Agent, or Firm*—Ronald E. Greigg

(57) ABSTRACT

Described is an apparatus for rapid pressure buildup in a motor vehicle reservoir-type injection system (common rail) supplied with fuel by a high-pressure pump, the apparatus including a piston, which defines a pressure chamber that can be enlarged counter to the force of a spring element prestressed counter to the piston, which pressure chamber communicates with the feed pump and with the device supplied with the pressure medium. A locking device acting on the piston is provided, by which the piston can be locked in a locking position, assumed as a result of the pressure, built up in the pressure chamber by the feed pump, counter to the prestressing of the spring element and can be untensed after unlocking into a position that reduces the size of the pressure chamber. By the relaxation of the spring, the system pressure is built up suddenly.

7 Claims, 1 Drawing Sheet

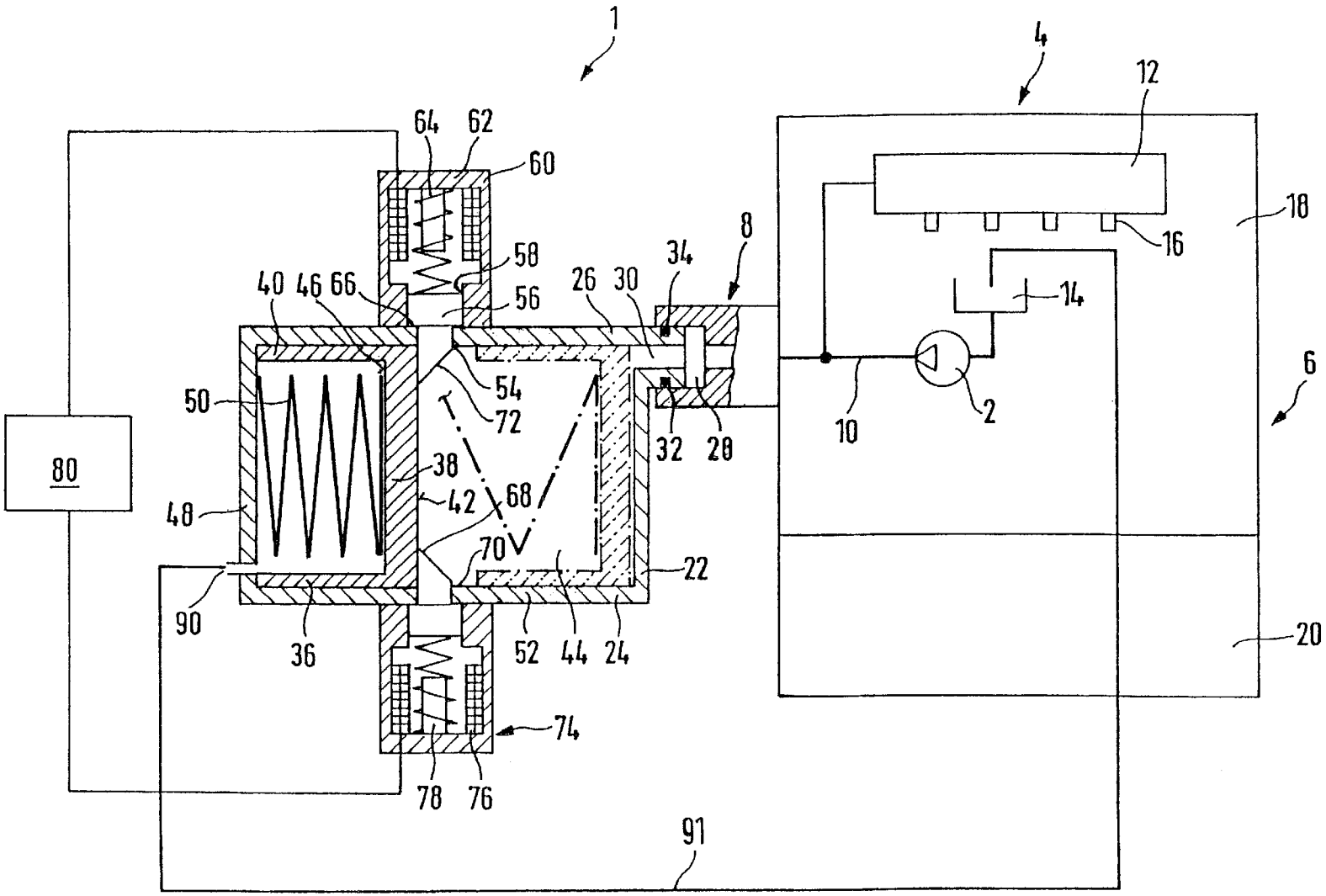
1
2
4
6
8
10
12
14
16
18
20
22
24
26
28
30
32
34
36
38
40
42
44
46
48
50
52
54
56
58
60
62
64
66
68
70
72
74
76
78
80
90
91

DEVICE FOR RAPIDLY BUILDING-UP PRESSURE IN A DEVICE OF A MOTOR VEHICLE, SAID DEVICE BEING SUPPLIED WITH A PRESSURE MEDIUM BY MEANS OF A FEED PUMP

CROSS-REFERENCE TO RELATED APPLICATIONS

This application is a 35 USC 371 application of PCT/DE 00/01726 filed on May 27, 2000.

BACKGROUND OF THE INVENTION

1. Field of the Invention

The invention is based on an apparatus for rapid pressure buildup in a motor vehicle device supplied with a pressure medium by a feed pump, in particular in a reservoir-type injection system (common rail) supplied with pressure by a high-pressure pump.

2. Description of the Prior Art

In modern internal combustion engines, high-pressure injection systems are increasingly used in which fuel is kept on hand in a storage volume at high pressure, so as to be distributed to injection valves, an example being reservoir-type injection systems (common rails) in self-igniting internal combustion engines and direction injection systems in internal combustion engines with externally supplied injection. In such high-pressure injection systems, the problem arises that even during starting of the engine, an adequately high pressure must be built up in the injection system. As a rule, the high-pressure fuel pumps used to supply the high-pressure injection systems with fuel are driven by the engine crankshaft, so that the pressure buildup at starter rpm proceeds too slowly and lengthens the starting time. Thus not only the high-pressure fuel pumps but also prefeed pumps are used, so that an adequate pressure level can be made available for starting. However, this means an increase of pollutants in the exhaust.

Furthermore, electrohydraulic valve control devices for gas exchange valves of internal combustion engines also operate at high pressure, at which hydraulic oil is brought by a hydraulic pump to a pressure level of 100 bar, for instance, for actuating gas exchange valve actuators hydraulically. Once again, the problem arises that the high pressure must already be available upon starting of the engine.

From European Patent Disclosure EP 0 455 761 B1, a hydraulic valve control device for controlling the gas exchange valves of an internal combustion engine is known, with a control pressure reservoir disposed upstream of a magnet valve and containing a piston, which defines a pressure chamber that can be increased in size counter to the force of a spring element prestressed counter to the piston. The pressure chamber of the control pressure reservoir is connected to a feed pump of the valve control device and can be made to communicate with its control lines via the magnet valve. While the magnet valve is in the closing position, the piston, because of the pressure built up in the pressure chamber by the feed pump, is forced, counter to the action of the spring element, into a position that increases the size of the pressure chamber. When the magnet valve is open, the pressure in the pressure chamber drops, because some of the hydraulic oil flows into the control lines. Because of the dropping counter pressure, the piston can decrease the size of the pressure chamber because of its spring prestressing, resulting in a pressure surge that makes it possible to make the control pressure in the control lines still more precise and to maintain that pressure.

In order beyond this originally provided purpose to make it possible also to keep high pressure available for an ensuing restart after the engine has been put out of operation, the magnet valve would have to remain closed during the entire time that the engine is off, so as to keep the pressure chamber constantly at high pressure and to keep the piston prestressed. Proceeding in this way, however, entails the problem that even the slightest leakages would mean that the high pressure in the pressure chamber would be degraded over time, and thus not enough pressure would be available for the restart of the engine. Furthermore, safety concerns advise against keeping high pressure on hand in a pressure reservoir of a motor vehicle, because if improper work is done on the pressure reservoir, accidents can happen.

SUMMARY OF THE INVENTION

The apparatus according to the invention has the advantage over the prior art that the piston used to generate a rapid pressure rise can be kept in its energy-storing position, prestressed counter to the spring element, solely by the locking device according to the invention. Thus leaks in the line system that cause a pressure loss in the pressure chamber cannot also lead to a loss of the energy stored by the piston. Since when the engine is off, because the feed pump is not in operation then, the pressure chamber is virtually without pressure anyway, if work is done on the motor vehicle there is no risk that the high pressure stored in the pressure chamber will discharge by itself.

In a preferred embodiment of the invention provides that the piston is guided longitudinally displaceably inside a closed cylinder, and the pressure chamber is formed between the piston and a bottom of the cylinder; this bottom is provided with a pressure connection, and by way of this bottom the pressure chamber is connected to a pressure line that effects communication between the feed pump and the device.

Expediently, the locking device includes two locking bolts, received in diametrically opposed receiving bores in the cylinder wall and in the outset position protruding into the cylinder in a direction transverse to the direction of motion of the piston and preferably prestressed in this direction by helical springs, which bolts can be forced back into their receiving bores by the motion of the piston in the direction of its locking position and, after the piston has moved past the bolts and reached its locking position, the bolts positively engage at least the edge of the piston, emerging from their receiving bores.

By the provisions recited, an automatic locking of the piston is attained because the pressure existing in the system assures that the piston will move past the locking bolts and push them back into their receiving bores. Once the piston has then reached its locking position, the spring-prestressed locking bolts automatically move out of the receiving bores and lock the piston.

BRIEF DESCRIPTION OF THE DRAWINGS

One exemplary embodiment of the invention is shown in the drawing and described in further detail in the ensuing description. The sole FIGURE of the drawing, in highly schematic form, shows an apparatus for rapid pressure buildup in a reservoir-type injection system (common rail) supplied with fuel by a high-pressure pump, in accordance with a preferred embodiment of the invention.

DESCRIPTION OF THE PREFERRED EMBODIMENT

In the exemplary embodiment shown in the drawing, the apparatus 1 according to the invention, serves the purpose of rapid pressure buildup in a reservoir-type injection system 4 (common rail), supplied with pressure by a high-pressure pump 2, of a self-igniting internal combustion engine 6 of a motor vehicle.

The apparatus 1 is connected via a pressure connection 8 to a pressure line 10, which affects communication between the high-pressure pump 2 and a distributor strip 12, downstream of the pump, of the reservoir-type injection system 4. The high-pressure pump 2 to this end draws fuel from a fuel tank 14, shown highly schematically in the drawing, and supplies the distributor strip 12 with fuel at high pressure which is then distributed in a known way to individual injection valves 16. The reservoir-type injection system 4 is disposed in the region of a cylinder head 18 of the engine 6 that is mounted on a cylinder block 20.

In detail, the apparatus 1 has a pipe stub 26, which is embodied in the bottom 22 of a housing 24 and is inserted into a stepped receiving bore 28 on the cylinder head 18. A connecting conduit 30, extending inside the pipe stub 26 and the receiving bore 28 between the apparatus 1 and the pressure line 10, is sealed off from the atmosphere by a sealing ring 34 received in a radially outer annular conduit 32 of the pipe stub 26. The housing is preferably embodied as an elongated cylinder 24, in which a cup-shaped piston 40, comprising a hollow-cylindrical piston wall 36 and a terminal piston bottom 38, is guided longitudinally. Between the bottom 22 of the cylinder 24 and the face 42, toward it, of the piston bottom 38, a pressure chamber 44 is defined, which communicates constantly with the pressure line 10 via the connecting conduit 30. The face 46 of the piston bottom 38 pointing away from the pressure chamber 44 is loaded by a helical spring 50, which is braced on a head plate 48 of the cylinder 24, is received partly inside the piston wall 36, and prestresses the piston 40 into positions that decrease the size of the pressure chamber 44.

Since the pressure chamber 44 is constantly in communication with the pressure line 10, in which in operation of the engine 6 fuel at feed pressure is pumped to the distributor strip 12, a correspondingly high pressure prevails in the pressure chamber 44 as well, and as a result the piston 40 is forced, counter to the action of the helical spring 50, into positions that increase the size of the pressure chamber 44. In order to lock the piston 40 in a locking position, represented by solid lines in the drawing, in which the pressure chamber 44 has a maximum size, defined for instance by the impact of the piston 40 on the head plate 48 of the cylinder 24, receiving bores 54, for instance diametrically opposite one another, are embodied in the cylinder wall 52, and in them, locking bolts 56 are guided that are displaceable transversely to the longitudinal axis and transversely to the direction of motion of the piston 40. Each locking bolt 56 is additionally guided in a through bore 58, aligned with the associated receiving bore 54 of the cylinder 24, on the bottom of a housing 60 mounted radially on the cylinder.

The locking bolts 56 are prestressed radially inward on the head end, each by a respective helical spring 64 braced on a head plate 62 of the housing 60, and in the outset state they therefore protrude into the interior of the cylinder 24. A shoulder 66, whose diameter is greater than that of the receiving bore 54, assures an impact of the locking bolts 56 on the edge of the associated receiving bore 54. The spacing of the locking bolts 56 from the head plate 48 of the cylinder 24 is essentially equivalent to the length of the piston 40.

As already described, starting the engine 6 drives the high-pressure pump 2, and generates a correspondingly high fuel pressure in the pressure line 10; this pressure is present in the pressure chamber 44 and in particular at the face 42 of the piston bottom 38 toward the pressure chamber 44. As a result, the piston 40 moves from an outset position, represented by dot-dashed lines in the drawing, in the region of the cylinder bottom 22 in which the pressure chamber 44 is vanishingly small, the piston 40 moves counter to the prestressing action of the helical spring 50 toward the locking bolts 56 protruding into the interior of the cylinder 24 and positively displaces the locking bolts back into their receiving bores 54 until the ends 68 toward the foot of the locking bolts 56 are flush with the inside face 70 of the cylinder wall 52. To facilitate this, the ends 68 toward the foot of the locking bolts 56 are shaped accordingly and are preferably tapered in wedgelike fashion radially inward, with the oblique wedge face 72 oriented toward the outset position of the piston 40. The spring rate of the helical spring 50 prestressing the piston 40 is expediently selected such that the force of the spring on the piston bottom 38 is less than the oppositely oriented pressure force that results from the operating pressure of the high-pressure pump 2. Unfortunately, it cannot be avoided that small quantities of fuel or hydraulic oil will pass between the cylinder wall 52 and the piston wall 36. To prevent the space between the piston bottom 38 and the head plate 48 from becoming flooded with fluid, an outlet 90 with a return line 91 is provided.

Once the piston 40 has moved past the locking bolts 56 and has preferably struck the end, oriented away from the pressure chamber 44, of the piston wall 36 at the head plate 48 of the cylinder, the locking bolts 56 are forced back out of the receiving bores 54 by the action of the helical springs 64 that prestress them, until they are seated with their shoulders 66 on the edges of the receiving bores 54. Then preferably the outer edge of the face 42 of the piston bottom 38 oriented toward the pressure chamber 44 is positively engaged from behind by the locking bolts 56. Since the spacing of the locking bolts 56 from the head plate 48 of the cylinder 24 is essentially equivalent to the length of the piston 40, the piston is now fixed on both sides in its locking position.

By means of current-excitable electromagnets 74 disposed inside the housings 60, the locking bolts 56 can be retracted, counter to the action of the helical springs 64 prestressing them radially inward, into the receiving bores 54, at least until their ends 68 toward the foot are flush with the inside face 70 of the cylinder wall 52. The electromagnets 74 comprise a magnet coil 76, which radially surrounds a magnet core 78. The locking bolts 56 then form armatures, upon which a magnetic attracting force is exerted by the delivery of current to the magnet coils 76. A corresponding electrical signal to deliver current to the magnet coils 76 is generated, for instance by an engine control unit 80, upon starting of the engine 6, and as a result the piston 40 is unlocked. Since at the instant of starting no significant pressure has yet been built up by the high-pressure pump 2, only a slight pressure still prevails in the pressure chamber 44. For lack of a counter pressure, the unlocked piston 40, driven by the prestressing force of the helical spring 50, therefore presses against the fluid in the pressure chamber 44, and as a result the pressure chamber 44 decreases in size. This creates a pressure rise in the pressure line 10, as a result of which the fuel/oil pressure in the distributor strip 12 is rapidly brought to an adequate level.

The foregoing relates to preferred exemplary embodiments of the invention, it being understood that other variants and embodiments thereof are possible within the spirit and scope of the invention, the latter being defined by the appended claims.

We claim:

1. An apparatus (1) for rapid pressure buildup in a motor vehicle reservoir-type injection system (common rail) (4) supplied with fuel by a high-pressure feed pump (2), the apparatus comprising a piston (40) defining a pressure chamber (44) communicating with the feed pump, said pressure chamber containing a spring element (50) prestressed counter to the piston, the piston being moveable counter to the force of the spring element (50) to enlarge the pressure chamber, a locking device (56, 64, 74) acting on and releasibly locking said piston in a locking position, assumed as a result of movement by pressure built up in said pressure chamber (44) by the feed pump (2), counter to the prestressing force of said spring element (50), means for unlocking said piston to permit movement of said piston by said spring element (50) to reduce the volume of the pressure chamber (44), said piston being guided longitudinally displaceably inside a closed cylinder (24), said pressure chamber (44) being formed between the piston (40) and a bottom wall (22) of said closed cylinder (24), said bottom wall being provided with a pressure connection connecting said pressure chamber (44) to a pressure conduit (10) affecting communication between the feed pump (2) and the common rail (4), wherein said locking device comprises two locking bolts (56), received in diametrically opposed receiving bores (56) in said closed cylinder wall (52), said locking bolts being movable between a first position protruding into the cylinder (24) in a direction transverse to the direction of motion of the piston (40) and a second position withdrawn from said cylinder, and spring means (64) biasing said locking bolts to said first position, said bolts being capable of being forced from said first to said second position by the motion of said piston (40) in a direction counter to the prestressing force of said spring element and, after said piston (40) has moved past the bolts and reached said first position, wherein the bolts positively engage and releasibly retain said piston (40) to retain said piston.

2. The apparatus of claim 1, wherein said closed cylinder comprises a closed head plate (48), and wherein the spacing of the locking bolts (56) from said head plate (48) is essentially equivalent to the length of the piston (40).

3. The apparatus of claim 2, wherein said piston (40) is cup-shaped, with a hollow- cylindrical piston wall (36) and a terminal piston bottom (38), and wherein said spring element, is a helical spring (50), received inside the piston wall (36) and is fastened between the piston bottom (38) and said head plate (48) of the cylinder (24).

4. The apparatus of claim 1, wherein said closed cylinder comprises a closed head plate (48), and further comprising a pressure relief bore (90) in said head plate (48) to permit leakage fluid to flow out of said closed cylinder (24).

5. The apparatus of claim 4, wherein said locking device further comprises current-excitable electromagnets (74) operable to more said locking bolts (56), from the first position to the second position against the face of said spring means for unlocking said piston (40).

6. The apparatus of claim 5, wherein said electromagnets (74) each include one magnet coil (76) radially surrounding a magnet core, and wherein said locking bolts (56) form armatures, upon which, by the delivery of electric current to the magnet coils (76), a magnetic attraction force can be exerted.

7. The apparatus of claim 6, wherein said electromagnets (74) are excited by current upon starting of the motor vehicle.

* * * * *